United States Patent [19]

Halsey et al.

[11] Patent Number: 4,520,604

[45] Date of Patent: Jun. 4, 1985

[54] SKYLIGHT STRUCTURE

[75] Inventors: Jay F. Halsey, Lake Hopatcong; Jeffrey M. Briggs, Oak Ridge, both of N.J.

[73] Assignee: RCA Corporation, Princeton, N.J.

[21] Appl. No.: 554,850

[22] Filed: Nov. 23, 1983

[51] Int. Cl.[3] ..... E04B 7/18

[52] U.S. Cl. ..... 52/200; 52/213; 52/397

[58] Field of Search ..... 52/200, 397, 213, 204, 52/398

[56] References Cited

U.S. PATENT DOCUMENTS

| | | | |
|---|---|---|---|
| 2,163,566 | 6/1939 | Blessin | 52/397 X |
| 2,266,973 | 12/1941 | Horton | 52/397 X |
| 2,610,593 | 9/1952 | Wasserman | 108/6 |
| 2,637,422 | 5/1953 | Bell | 52/397 |
| 2,875,710 | 3/1959 | Bechtold | 108/16 |
| 3,090,613 | 5/1963 | Bechtold | 268/99 |
| 3,111,786 | 11/1963 | Wasserman | 50/16 |
| 3,127,699 | 4/1964 | Wasserman | 50/16 |
| 3,137,099 | 6/1964 | Wasserman | 50/116 |
| 3,455,073 | 7/1969 | Kiekhaefer | 52/200 |
| 3,731,442 | 5/1973 | Kiyoshi | 52/232 |
| 3,774,363 | 11/1973 | Kent | 52/400 |
| 3,918,226 | 11/1975 | Naidus | 52/232 |
| 3,934,383 | 1/1976 | Perry et al. | 52/200 |
| 3,983,669 | 10/1976 | Bogaert | 52/200 |
| 4,073,097 | 2/1978 | Jentoft et al. | 52/200 |
| 4,080,763 | 3/1978 | Naidus et al. | 52/200 |
| 4,388,784 | 6/1983 | Jentoft et al. | 52/200 |
| 4,468,899 | 9/1984 | Miller | 52/200 X |

OTHER PUBLICATIONS

"Dayliter SKY-VUE Skylights," *Catalog Sheets.*

"APC Dayliter Vents," *Catalog Sheets* 7.8-81, pp. 1-12.

"Skylighting with Ventarama", *Catalog Sheets.*

"This is the Original Ventarama," *Catalog Sheets.*

Sweets 1977 Catalog, 7.8/Hi, Hillsdale; 7.8/Na, Naturlite, Dec. 1976, p. 5.

Sweets 1977 Catalog, 7.8/Du, Dur-Red; Wasco, Dec. 1976.

*Primary Examiner*—Carl D. Friedman

*Attorney, Agent, or Firm*—Joseph S. Tripoli; George E. Haas; William Squire

[57] ABSTRACT

A curb structure is dimensioned to be passed through an opening in a roof and then attached in moisture impervious relation to the roof from within a building interior. A skylight assembly including a frame and light transmitting member secured to the frame is dimensioned to be passed through the opening and attached in a sealing engagement to the curb structure from within the building interior for covering the opening. The skylight assembly is then secured to the rafters and headers at an interior location. The frame includes upper and lower clamping jaws and spaced fulcrum links attached to the jaws for clamping the light transmitting member thereto. The lower clamping jaw includes a channel which engages and is interlocked with the curb structure.

12 Claims, 5 Drawing Figures

Fig. 3
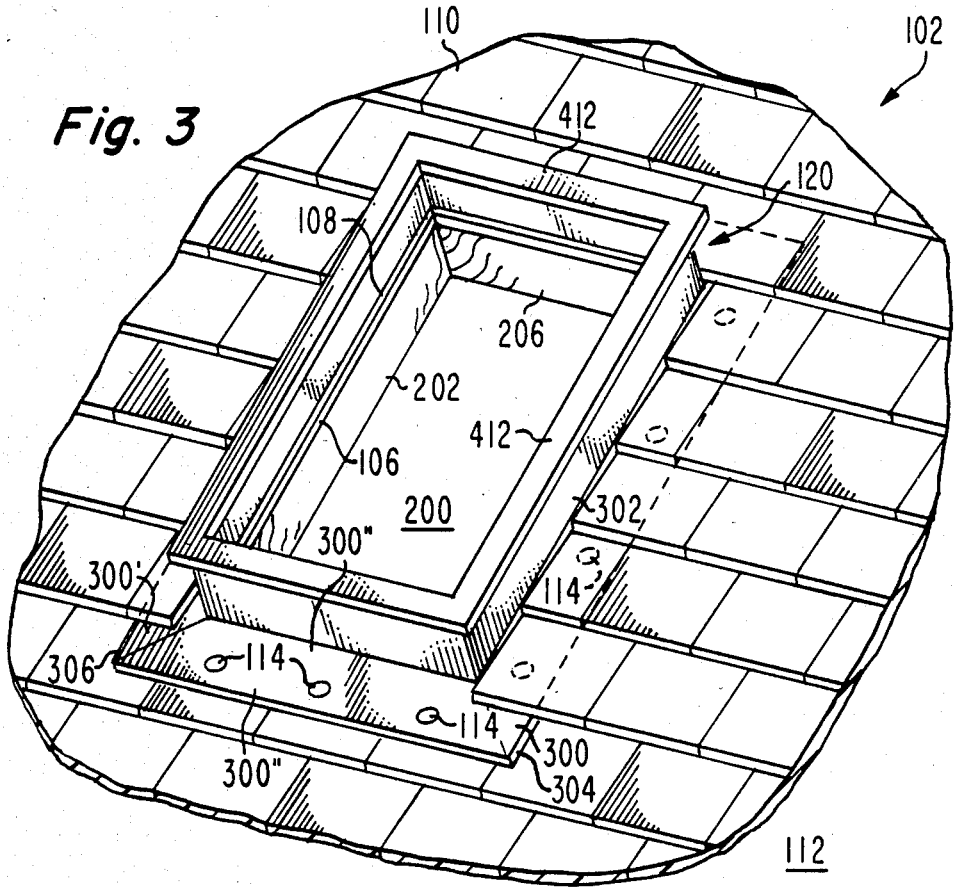
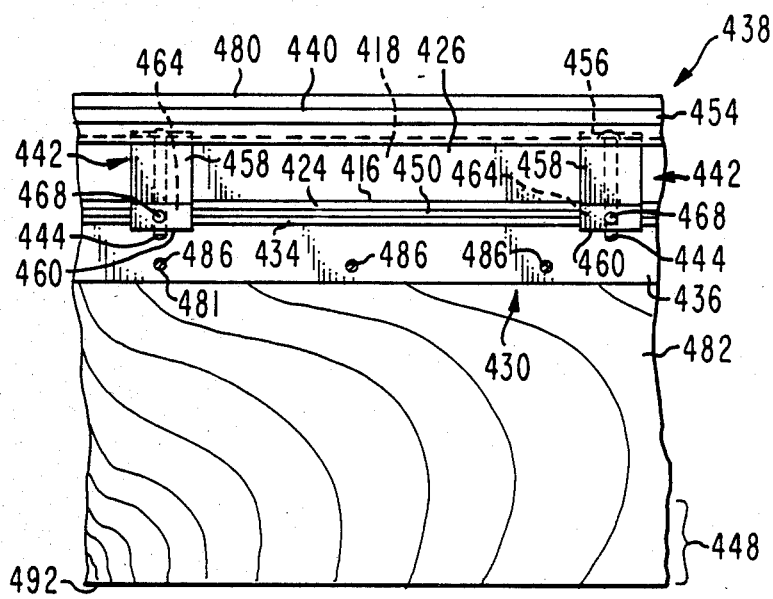
Fig. 5

SKYLIGHT STRUCTURE

The present invention relates to building enclosures, and more particularly, to skylight structures.

Skylight structures are prefabricated for attachment as a unit to a finished roof. An example of one such structure is shown in U.S. Pat. No. 3,090,613. This skylight structure may be installed as a unit after making a simple rectangular cut in an existing roof, or may be installed in a roof under construction. An example of a second structure is shown by U.S. Pat. No. 2,875,710 which can be installed in sections to a finished roof. Other examples of skylight structures are shown in U.S. Pat. Nos. 2,610,593; 3,111,786; 3,127,699; 3,137,099; 3,455,073; 3,731,442; 3,774,363; 3,918,226; 3,983,669; 4,073,097; and 4,080,763.

A skylight structure such as in U.S. Pat. No. 3,090,613 comprises an integral structure including a light transmitting member and a frame and curb assembly to which the light transmitting member is secured. The curb assembly includes a flashing frame which is covered by shingles overlying roof sheathing to provide water impervious coupling to the roof. The light transmitting member is secured to a frame structure which is attached to the curb structure either prior to installation on the roof so that the entire unit can be installed as a unit, or after installation of the curb structure.

The prior art frame structures employ relatively large amounts of material. The curb and frame assembly usually include metal elements which extend fully around the skylight. The frame assembly may comprise aluminum extrusions including clamping arrangements for securing the light transmitting member thereto. The number of different elements add weight and cost to the resulting structure.

A skylight structure according to one embodiment of the present invention for covering an opening in a wall comprises an annular curb member, the curb member including first means for securing the member to an exterior surface of the wall and second means including an annular surface surrounding a central opening in the curb member and of about the same extent as the wall opening. A frame structure includes means for securing a light transmitting member thereto for covering the opening and further includes means for securing the frame structure to the wall at a location interior the annular curb member. The means for securing the light transmitting member include first and second clamping members for securing the light transmitting member therebetween at first ends of the clamping members, the clamping members having spaced second ends opposite the first ends. Pivot means are engaged with the second ends. Pressure applying means are coupled to the first and second clamping members and adjustably secured thereto for drawing the clamping members first ends together. The frame structure includes an annular surface adapted to mate with the curb member annular surface. A sealing member is adapted to sealingly abut the curb member annular surface and the frame structure annular surface, the sealing member being dimensioned to extend continously around the annular surfaces.

In the drawings:

FIG. 3 is an isometric view similar to that of FIG. 1 illustrating partial assembly of the skylight structure of FIG. 1;

FIG. 5 is an elevation view of a portion of the frame assembly of the structure of FIG. 1.

Figure 1:
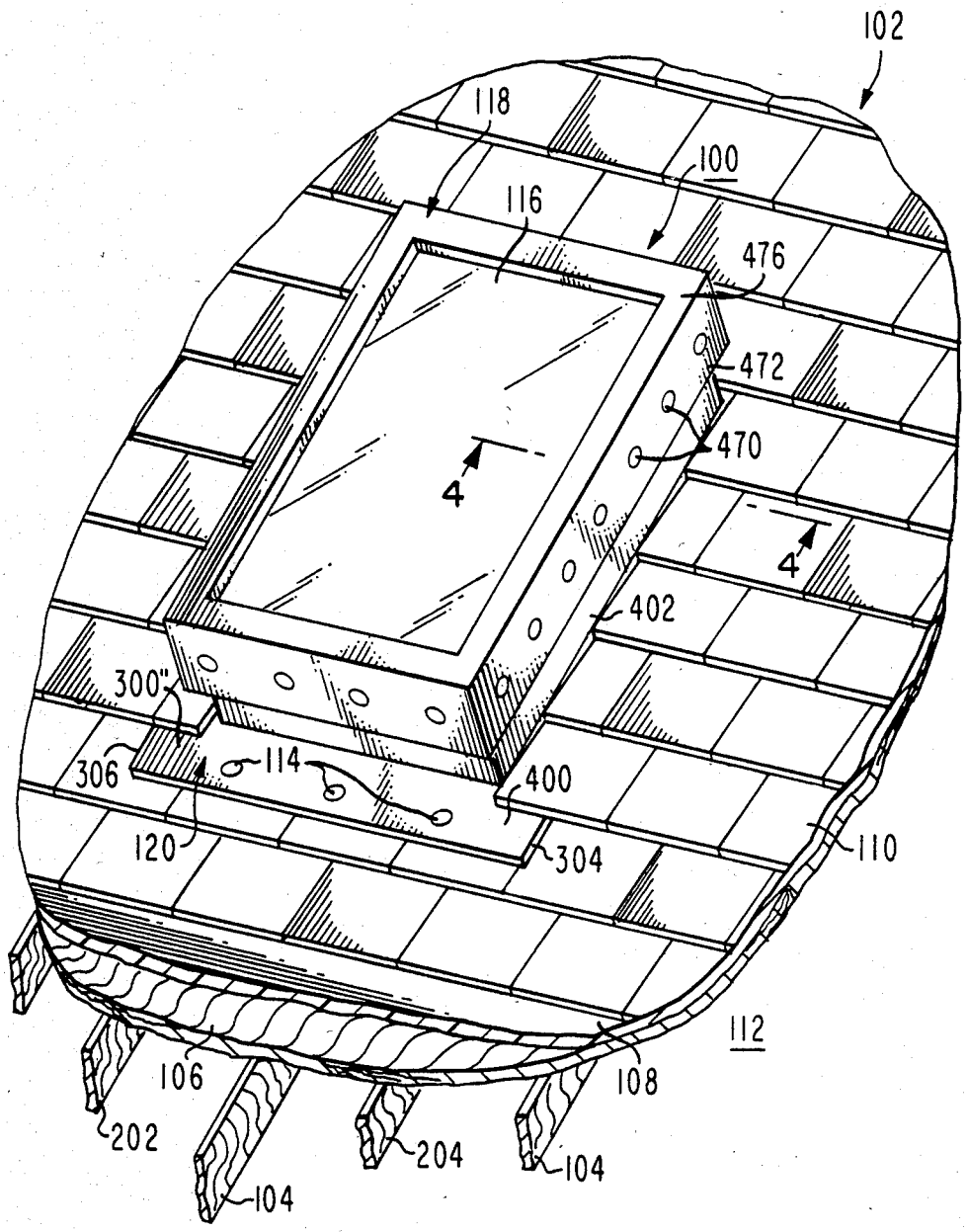
FIG. 1 is an isometric view of a skylight structure according to one embodiment of the present invention.

In FIG. 1, skylight structure 100, according to one embodiment of the present invention, is shown installed on a roof 102. Roof 102 is conventional and includes rafters 104 over which is sheathing 106 which may be plywood or other board material nailed to the rafters 104. Sheathing 106 is covered with a water barrier 108, such as felt, tar paper, or other water impervious sheet material. Placed over the barrier 108 are shingles 110.

The skylight structure 100, as will be described, can be easily installed by an unskilled individual from entirely within the interior space 112 beneath the roof 102 without stepping onto the roof exterior. This skylight structure 100 can be so installed even though the structure 100 is installed in water impervious relation to the roof 102 and may be fastened to the roof 102 by nails 114 exterior the skylight structure.

Figure 2:
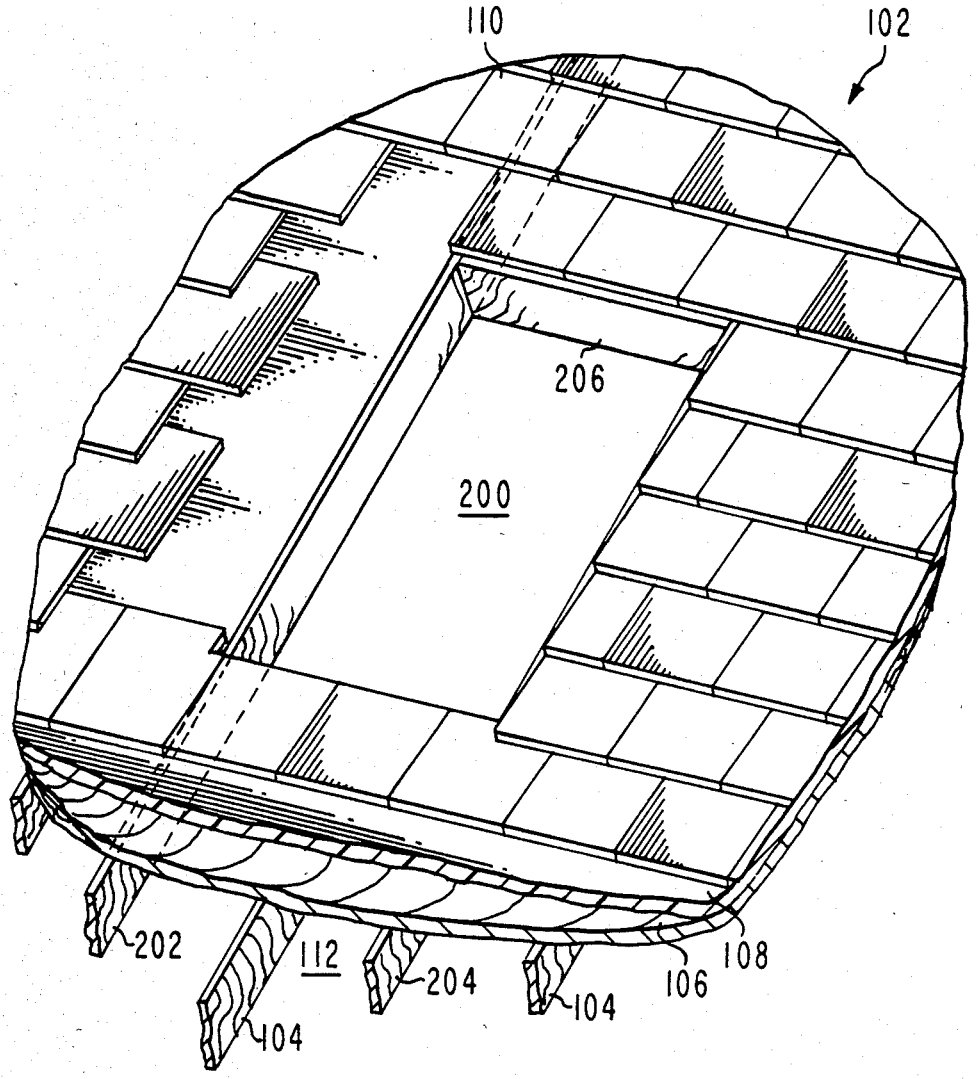
FIG. 2 is an isometric view of a building roof similar to the view of FIG. 1 prior to installation of the skylight structure of FIG. 1.

Skylight structure 100 comprises a light transmitting member 116, a frame 118 to which the member 116 is secured, and a curb structure 120 which seals the frame 118 to the roof 102. Structure 100 covers a square or rectangular opening 200 in roof 102, FIG. 2. With reference to FIG. 2, opening 200 can be formed in roof 102 by an unskilled individual standing on the floor or a ladder (not shown) of a room of interior space 112 beneath roof 102 by sawing the sheathing 106, barrier 108, and shingles 110.

Opening 200 is surrounded by rafters 202 and 204 and headers 206. Headers 206 (only one being shown) are nailed parallel between and to rafters 202, 204 to form the side walls of the opening 200 in the plane of the rafters 104. The shingles 110, sheathing 106, and barrier 108 are all cut coplanar with the interior side walls of rafters 202, 204 and the headers 206.

Figure 4:
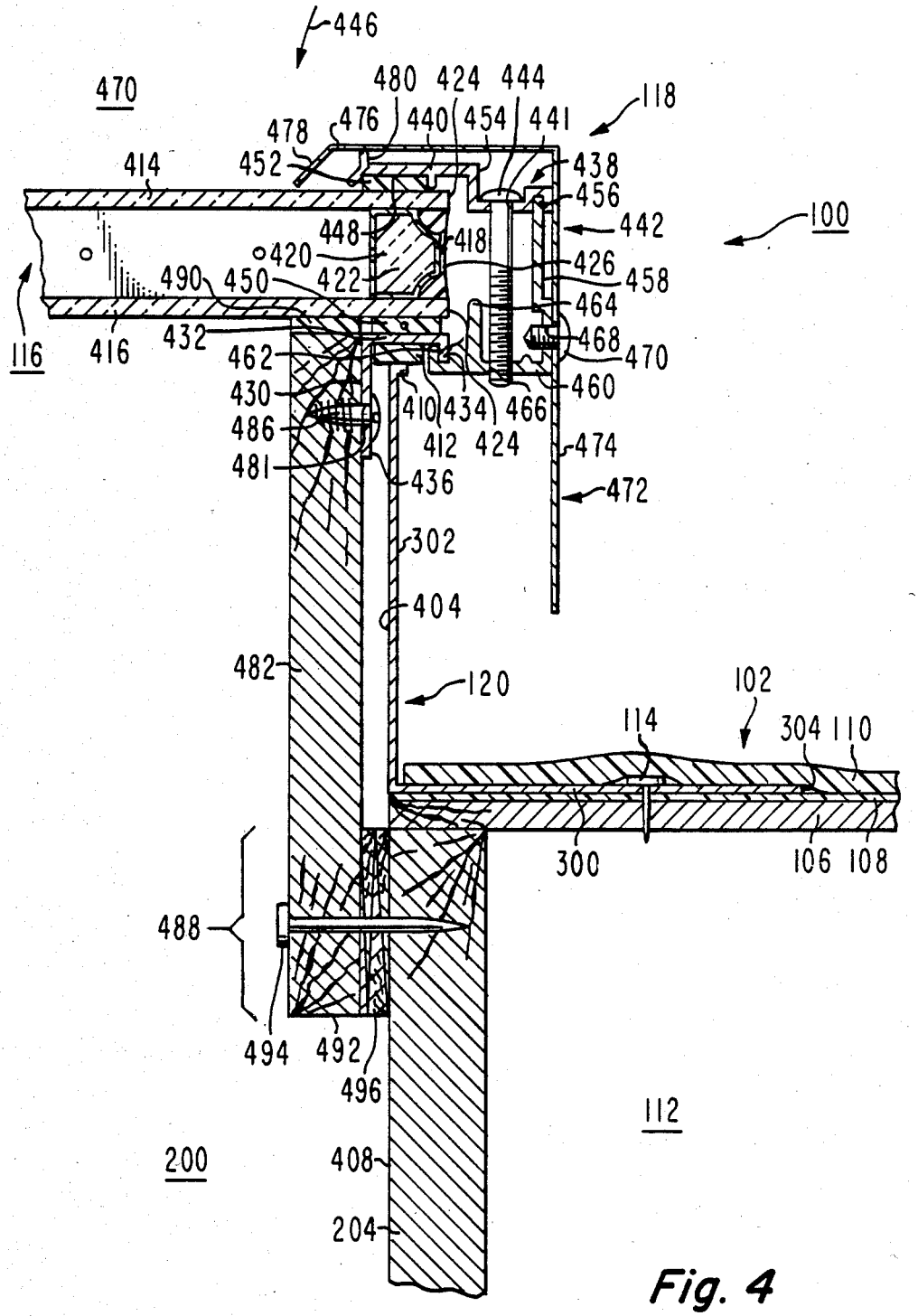
FIG. 4 is a sectional view through a portion of the structure of the embodiment of FIG. 1 taken along lines 4—4.

The structure 100 including the frame 118, the light transmitting member 116, and the curb structure 120 are dimensioned to pass through the opening 200, FIG. 2, and are also sufficiently large to cover the opening 200 when installed as shown in FIG. 1. Curb structure 120 comprises sheet metal formed into an annular rectangle, FIG. 3. Curb structure 120 has an upstanding rectangular curb leg 302 and an outwardly extending annular rectangular flange or flashing member 300 which is attached to roof 102 by nails 114. Curb leg 302, FIG. 4, is perpendicular to leg 300. In FIG. 4, the sectional view shown is representative of the curb structure 120 throughout. The inner surface 404 of curb structure 120 is approximately coextensive with the opening 200 inner wall surfaces of the adjacent rafters 202, 204, and headers 206. The curb structure 120 may be formed from a single sheet of metal and bent into the L shape of FIG. 4 or formed from separate sheets or extrusions butt welded at mitered corners.

In FIG. 4, the upper edge of upstanding leg 302 has a radially outwardly extending lip 410. A rectangular gasket strip or sealing member 412, FIG. 4, is bonded to the upper rectangular surface of lip 410. The sealing member 412 extends completely around the opening 200 on lip 410 (FIG. 3). Member 412 may be made out of neoprene, rubber, or other sealing materials. The abutting surfaces of member 412 and lip 410 form a waterproof seal. An important consideration is that the dimensions of the curb structure including the sealing member, the flashing members, and legs are chosen so that the combined structure, FIG. 3, is dimensioned so that it will pass through the opening and still surround that opening when attached to the roof.

The curb structure comprising the flashing members 300, upstanding legs 302 and the sealing member 412 adherently secured to the lip 410, FIG. 4, is passed through the opening 200 from within the interior space 112. The installation of structure 120 requires a portion of the shingles 110 around and adjacent opening 200 be temporarily removed as shown, by way of example, at 110′, FIG. 2. Barrier 108, FIG. 4, is bared for a distance spaced from and around the opening 200 greater than the width of the flashing members 300. This permits the flashing members 300 to be placed between the shingles 110 and the barrier member 108. One exception is that the lowermost (in elevation) flashing member 300″ is placed over the corresponding shingles 110 (FIG. 3) to permit water to run over the shingles 110 at the lower part of the curb structure.

Prior to placing the previously removed shingles 110 over the respective flashing members 300, the flashing members may be secured in place by nails 114 or glued to barrier 108. Nails 114 pass through the plywood sheathing 106 securing the curb structure 120 to the roof 102. Upon completion of the nailing or glueing of the flashing members, the shingles are then placed over the flashing members, FIG. 3. All of the above can be done by a person standing in the opening 200.

The frame 118 and light transmitting member 116, FIG. 4, are factory preassembled, and can be installed by an unskilled individual onto the now installed curb structure 120, FIG. 3. The combined frame 118 and light transmitting member 116 assembly is passed through the opening 200 formed by curb structure 120 and the rafters and headers. The relative dimensions of the frame and light transmitting member for passing them through the opening 200 can also be determined by one of ordinary skill in the skylight art.

The frame and light transmitting member assembly is constructed as follows. The light transmitting member 116 in the illustrative embodiment is a dual-pane thermoglass structure. However, triple-pane and single-pane light transmitting members may be also used. While glass is shown, thermoplastic, either translucent or clear material may be used.

Member 116, FIG. 4, comprises two panes 414 and 416 of flat glass. Hollow rectangular rib 418, interior 420 is filled with a desiccant 422. Rib 418 is spaced slightly to the interior of exterior edges 424 of the panes 414 and 416. Rib 418 is bonded to the panes with a polysulfide sealing material 426 which seals the panes together at edges 424. Member 116 is rectangular and covers the opening 200, FIGS. 1 and 3.

The frame 118, FIG. 4, comprises annular channel member 430 having a base wall 432 whose inner surface rests on the upper surface of the sealing member 412, as shown. Member 430 has an outer depending side wall or lip 434 and an inner depending leg or side wall 436. The channel of member 430 rests in sealing engagement with the sealing member 412 continuously around the opening 200. Member 412 seals channel member 430 to the upstanding leg lip 410 of the curb structure 120. Lip 434 and wall 436 lock the channel member 430 in a direction generally transverse direction 446. A butyl gasket 450 in the form of an annular rectangular strip abuts and rests in sealing engagement with the upper outer surface of the channel member 430 base wall 432. The gasket 450 extends completely around opening 200. Pane 416 of the light transmitting member 116 is clamped to the gasket 450 in sealing engagement therewith. The gasket 450, as commercially available, includes a spacer element interior thereof to preclude permanent deformation of the gasket.

A clamping assembly 438 clamps the light transmitting member 116 to the channel member 430. Clamping assembly 438 includes clamping jaw 440 which extends fully around the opening 200 over the upper surface of light transmitting member 116 adjacent edge 424. Jaw 440 is above and aligned with rib 418 and channel member 430 and is cantilevered beyond the edge 424 of pane 414. The clamping assembly 438 also includes a plurality of fulcrum or pivot links 442 spaced around the periphery of frame 118, FIG. 5, and a like plurality of self-tapping clamping screws 444. Screws 444 clamp jaw 440 toward channel member 430 in direction 446 to firmly clamp the light transmitting member 116 between jaw 440 and base wall 432.

In FIG. 5, the links 442 have a width from left to right of the drawing of relatively small dimension, for example, one inch, and are spaced around the periphery of the light transmitting member 116. This spacing, by way of example, may be about ten inches. The pivot links 442, because they are discontinuous around the frame periphery, tend to minimize the amount of material employed in frame 118.

Jaw 440 includes a channel 448 over the peripheral outer surface of pane 414. A butyl gasket 452 similar to gasket 450 is in the channel 448 abutting pane 414 around the periphery. Gasket 452 is squeezed by jaw 440 against pane 414 by the clamping action of assembly 438. That clamping action also squeezes the pane 416 via rib 418 against gasket 452.

Jaw 440 includes a reinforcing rib 454 which extends for the full length of jaw 440 and has a channel 456 at its extended edge in which is received the upper edge of each of the fulcrum links 442. The channel 456 extends continuously throughout the length of jaw 440 around the periphery of member 116. Jaw 440 also includes an upstanding rib 480.

In FIG. 4, link 442 is L shaped and includes an upstanding leg 458 and a leg 460 normal to leg 458 inwardly extending toward opening 200. Leg 460 includes a channel 462 in which is closely received downward depending lip 434 of channel member 430 in interlocking fashion. The outer edge of leg 460 is thus locked with lip 434 of member 432. The upper edge of upstanding leg 458 is received in, and, thus interlocked with channel 456 of jaw 440.

The link 442 includes an upstanding strengthening rib 464 adjacent channel 462. Leg 460 has a threaded aperture 466 formed by the threads of the self-tapping screw 444. Jaw 440 has a plurality of apertures 441, each aligned with a corresponding fulcrum link 442 aperture 466 in leg 460. Leg 458 of link 442 has an aperture 468 for receiving a self-tapping screw 470. The jaw 440 can pivot somewhat with respect to the leg 458.

Clamping assembly 438 clamps the light transmitting member 116 to the channel member 430 as follows. The screws 444 are tightened forcing the clamping jaw 440 in direction 446 squeezing gaskets 450, 452, and member 116 against member 430. This pivots the jaw 440 at a fulcrum point formed by the upstanding edge of leg 458 in channel 456.

However, the links 442 and corresponding screws 444 are spaced in an annular rectangular array throughout the periphery of the frame 118. The screws 444 are sequentially tightened around the periphery to progressively apply uniform pressure between the jaw 440 and the leg 460 of the fulcrum links 442. As the jaw 440 is moved in the direction 446 about its pivot point in the channel 456, the jaw 440 pivots toward leg 460 of link 442. However, this pivoting action would tend to be in an opposite angular direction than the pivoting action of the jaw 440 on the diametrically opposite side of the light transmitting member 116. Since jaw 440 is an integral member, the actual displacement during this pivoting action is relatively small and is due to the relative flexibility of the material of which the jaw 440 is made, for example, extruded aluminum or other flexible sheet material. Thus, there is some elastic deformation of the jaw 440 when the screws 444 are tightened against the respective links 442. Because the gaskets 450, 452, and 412 extend continuously as an integral unit fully around the opening 200 they form a water impervious seal between the ambient environment at 470 and the interior at opening 200.

An apron 472 is installed over the outer surface area of the jaw 440 and links 442. The apron is an annular rectangular member, L shaped in cross-section, having a downwardly depending leg 474 and an inwardly extending leg 476 having an inwardly downardly bending portion 478 bent toward the pane 414 to cover the jaw 440. The inward leg 476 rests on rib 480. The leg 474 of the apron 472 is secured to the links 442 by screws 470 at apertures 468. The apron 472 is preassembled to the clamping assembly 438 at the factory.

Leg 436 of channel member 430 includes a plurality of spaced holes 481. Rectangular wooden box-like frame 482 is fastened by screws or nails 486 to channel member 430 leg 436 at holes 481 around the opening 200. Frame 482 extends from leg 436 to a location an amount sufficiently below the curb structure 120 so that frame 482 portion 488 faces at least a portion of each of the rafters or headers, such as rafter 204 (or header 206, FIG. 3). Gasket 490 seals the pane 416 to the frame 482 interior of the gasket 452. Gasket 490 provides an additional vapor and condensation barrier and is optional. The frame 482 is factory assembled.

After passing the frame and light transmitting member assembly through the opening 200, the combined structure is placed on the sealing member 412, FIG. 4. The weight of the light transmitting member 116 and frame assembly 118 is sufficient to provide good sealing engagement between the sealing member 412 and the abutting surface of the member 430 prior to fastening frame 482 to the rafters and headers. Once so installed, wooden frame 482 is nailed with nails 494 to the rafters and headers. Shims 496, FIG. 4, may be used to fill the space, if any, between the frame 482, portion 488, and the adjacent rafter or header. The frame 482 may be sized smaller than the interior dimensions of the opening 200 to permit easy installation. The shims 496 can be readily inserted from the interior at opening 200. Once nailed in place, the frame 482 can no longer be lifted in a direction opposite direction 446 and the assembly cannot be lifted or removed from a location exterior the roof 110.

What is claimed is:

1. A skylight structure for enclosing an opening in a wall, comprising:

an annular curb member including a flange element for securing the member to and exterior from said wall and an upstanding wall having an edge surface extending around the periphery of said opening;

a skylight assembly including a light transmitting member and a frame member, said frame member having a sealing surface adapted to be in abutting sealing engagement with a sealing member at the periphery of said opening, said frame member including first and second spaced clamping elements positioned so that the periphery of said light transmitting member is between said clamping elements, a plurality of pivot links spaced around the periphery of said light transmitting member each connected to said first and second elements, and clamp adjustment means coupled to one of said clamping elements and to said pivot links for squeezing said light transmitting member between said clamping elements;

a sealing member adapted to extend continuously around said opening between said edge surface of said upstanding wall and said frame member sealing surface; and a skylight securing member secured to and depending from said frame member and adapted to be secured to said wall at a location interior to said skylight assembly.

2. The skylight structure of claim 1 wherein said first clamping element includes a depending wall, said securing member includes a member secured to the first element depending wall and depending therefrom juxtaposed with and interior to said curb member upstanding wall.

3. The skylight structure of claim 1 wherein said first clamping element includes an annular channel member having a base wall and first and second side walls, said base wall abutting and engaged with said sealing member, said first and second side walls extending adjacent to said upstanding wall edge for transversely locking said upstanding wall edge thereto.

4. A skylight structure for enclosing an opening in a roof comprising:

an annular L-shaped member including a first annular leg extending generally normal to a second annular upstanding leg, said member having an interior opening formed by said legs;

a sealing member adapted to be secured to the upstanding edge of one of said legs and having a length extending continuously around said interior opening;

a skylight assembly comprising a frame and a light transmitting member attached to the frame, said frame extending about the peripheral portion of said light transmitting member and including a channel portion having a base wall and first and second side walls, said channel portion being adapted to abut and sealingly engage said sealing member at said base wall interior to said channel, the engagement of said base wall to said sealing member being such that said frame can readily lift off said sealing member, said channel portion being interlocked with said upstanding leg; and means secured to the assembly for fixedly attaching the skylight assembly to said roof at a location interior to said roof and skylight assembly.

5. The skylight structure of claim 4 wherein said frame comprises first and second spaced frame elements extending around and abutting opposite surfaces of the peripheral edge of said light transmitting member, one of said elements extending beyond said opposite member surfaces, a plurality of pivot link means spaced about said peripheral edge between and abutting said elements, and means engaged with said elements for urging said elements toward one another at a location between said pivot link means and said light transmitting member to thereby clamp said light transmitting member to and between said elements.

6. The skylight structure of claim 5 wherein said elements each include a rib extending along the length thereof adjacent said clamping means intermediate said pivot link means and the peripheral edge of said light transmitting member.

7. A skylight structure including a light transmitting member to be secured over an opening to an exterior surface of a wall, comprising:

a curb member including flange means for securing the curb member to said wall exterior surface, said curb member having a surface spaced from said wall exterior surface;

an annular frame structure including a light transmitting member secured thereto adapted to cover said opening when placed over said opening, said frame structure comprising a first annular rectangular sheet material element having first and second oppositely facing channels, a second annular rectangular sheet material element having a third channel oriented in the same direction as one of said first and second channels, and a plurality of link means each having first and second edges, one edge located in the third channel and the other in the one channel;

a sealing element secured to one surface of said curb member and said third channel in sealing engagement therewith, the other of said curb member and third channel being adapted to abut said sealing element in sealing relationship; and means attached to said second element for securing said frame structure to said wall interior to said light transmitting member.

8. A skylight structure for covering an opening in a wall comprising:

an annular curb member, said curb member including first means for securing the member to a surface of said wall and second means including an annular surface surrounding a central opening in said curb member and of about the same extent as said wall opening;

a frame structure including means for securing a light transmitting member thereto for covering said opening and further including means adapted to secure said frame structure to said wall at a location interior to said annular curb member, said means for securing said light transmitting member including first and second clamping members for securing said light transmitting member therebetween at first ends of said clamping members, said clamping members having spaced second ends opposite said first ends, pivot means engaged with said second ends and pressure applying means coupled to said first and second clamping members and adjustably secured thereto for drawing the clamping members first ends together;

said frame structure including an annular surface adapted to mate with said curb member annular surface; and a sealing member adapted to sealingly abut said curb member annular surface and said frame structure annular surface to seal said annular surfaces thereto, said sealing member being dimensioned to extend continuously around said annular surfaces.

9. In a skylight structure having a light transparent member, a clamping apparatus comprising:

a first annular member having a peripheral edge;

a second annular member facing the first member and having a peripheral edge;

a plurality of spaced fulcrum elements releasably secured to said first and second annular members at their respective peripheral edges, said first member being pivotally secured to said fulcrum elements at the first member edge;

adjust means attached to said first member and said elements for pivoting said first member toward said elements and said second member; and sealing means abutting the facing surfaces of said first and second annular members for sealingly engaging the light transparent member therebetween when said adjust means pivots said first member about said fulcrum elements toward said second member.

10. The clamping apparatus of claim 9 wherein said second member comprises a channel member having a base wall and a pair of legs, the base wall outer surface outside the channel being located to face said first member, said elements each comprising an L-shaped member, a channel being formed in one leg of each element, one leg of said channel member being in said element leg channel, the other leg of said L-shaped member having an outer edge, said first member and its edge having a channel engaged with said L-shaped member other leg outer edge, said adjust means comprising a plurality of spaced adjustment means, each engaged with a different corresponding element and said first member.

11. The apparatus of claim 9 wherein said second annular member has a channel having a base wall, and a pair of side walls, the apparatus further including an L-shaped support structure having the edge of one leg sealingly engaged with said base wall, and means depending from and secured to a side wall of said second annular member interior said L-shaped support structure and extending from said second annular member an extent greater than that of said one leg of said L-shaped member.

12. A curb structure for securing a light transmitting member over an opening in a wall comprising:

upper and lower annular clamping members;

means for adjustably securing the members relative to each other for clamping said light transparent member therebetween;

an annular L-shaped curb member surrounding a central region, one leg of which being upstanding and engaged with said lower annular member at the upper extended edge of said one leg, the other leg of the L-shaped member being spaced from said upstanding leg edge a given extent and extending outwardly away from said central region, said annular members and L-shaped member being dimensioned to pass through said opening; and an annular securing member secured to and depending from said lower clamping member, said annular securing member being juxtaposed interior to said L-shaped member one upstanding leg and extending from said lower annular clamping member a distance of greater extent than said given extent.

* * * * *